US006645001B2

(12) United States Patent
Okano

(10) Patent No.: US 6,645,001 B2
(45) Date of Patent: Nov. 11, 2003

(54) PLUG CONNECTOR WITH FILM SHAPED CONDUCTIVE PART

(75) Inventor: Kazuya Okano, Kanagawa-ken (JP)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/796,298

(22) Filed: Feb. 28, 2001

(65) Prior Publication Data

US 2002/0022398 A1 Feb. 21, 2002

(30) Foreign Application Priority Data

Feb. 29, 2000 (JP) ..... 2000-054485

(51) Int. Cl.[7] ..... H01R 12/24

(52) U.S. Cl. ..... 439/492; 439/67; 439/630; 439/660; 439/866; 439/931

(58) Field of Search ..... 439/492, 493, 439/67, 499, 630, 631, 632, 886, 660, 931, 59, 60, 77

(56) References Cited

U.S. PATENT DOCUMENTS 4,072,387 A * 2/1978 Sochor ..... 339/91 R
4,353,372 A * 10/1982 Ayer ..... 128/640
4,871,319 A 10/1989 Babow ..... 439/77
4,959,030 A * 9/1990 Tatebe et al. ..... 439/67
4,969,842 A * 11/1990 Davis ..... 439/629
4,993,968 A * 2/1991 Guletsky et al. ..... 439/492
5,074,797 A * 12/1991 Yamada ..... 439/62
5,219,117 A 6/1993 Lin ..... 228/253
5,322,447 A * 6/1994 Okada ..... 439/79
5,360,353 A * 11/1994 Kinoshita ..... 439/620
5,626,483 A 5/1997 Naitoh ..... 439/74
5,679,008 A * 10/1997 Takahashi et al. ..... 439/76.1
5,964,594 A * 10/1999 Saitoh et al. ..... 439/74
6,000,955 A * 12/1999 Zaderej ..... 439/79
6,290,532 B1 * 9/2001 Vermeersch et al. ..... 439/460
6,350,145 B1 * 2/2002 Chen et al. ..... 439/422

* cited by examiner

*Primary Examiner*—P. Austin Bradley
*Assistant Examiner*—Truc Nguyen
(74) *Attorney, Agent, or Firm*—Perman & Green, LLP

(57) ABSTRACT

A plug connector is provided that can reduce the number of parts and the number of assembly steps. A plug connector 20 that fastens the distal ends of an inner conductor (conducting wire) 25*a* and engages a receptacle, and at the same time by this engagement, the contacts provided in this receptacle and said inner conductor 25*a* are brought into electrical continuity, wherein a ground housing (substrate), which is an insulator, is provided, and on the surface of the plug housing 21, a film-shaped conducting part 28 is formed that is in contact with the contact of the receptacle in a state wherein the plug connector 20 and the receptacle are engaged, and the distal ends of the inner conductors 25*a* in the conducting part 28 are connected.

6 Claims, 8 Drawing Sheets

PLUG CONNECTOR WITH FILM SHAPED CONDUCTIVE PART

FIELD OF THE INVENTION

The present invention relates to a plug connector, and in particular to the structure of a connection thereto of a conducting wire.

BACKGROUND OF THE INVENTION

An example of a conventional connector is shown in FIG. 8.

A plug for a connector is illustrated. Reference numeral 1 is a flat ribbon cable, and a plurality of wires 3 is arranged in parallel. In the figure, the wires 3 are arranged in the direction of the paper surface. The distal ends of the wires 3 wrap around a cable holder 4 to curve into a U-shape, and engage with the base of a plug connector 5 from the outside. The plug connector 5 engages with a receptacle (not illustrated), and thereby the electrical continuity between the plug and the receptacle is established.

Thus, in a conventional connector, because the cable must be joined with the plug by assembling a plurality of members, there are the problems that the number of parts is high, and in addition, the number of assembly steps is high.

In consideration of the above-described problems, it is an object of the present invention to provide a plug connector that has a decreased number of parts and assembly steps.

SUMMARY OF THE INVENTION

The plug connector in one embodiment is a plug connector which connects distal ends of electrically conducting wires and engages receptacles, and in which said electrically conducting wires and contacts provided in said receptacles conduct electricity due to the engagement. This plug connector is characterized by comprising a substrate for an insulating body, and a film-shaped conducting part formed on a surface of said substrate, said film-shaped conducting part making contact with the contact of said receptacle when said plug connector and said receptacle are engaged, wherein the distal end of said electrically conducting wire is connected to said conducting part.

In this embodiment of the plug connector, the conducting wire and the receptacle are electrically connected via a film-shaped conducting part formed, for example, by plating the substrate surface.

In another embodiment, the plug connector has holes which are provided in said substrate and, with respect to each hole, said conducting part comprises a connecting conducting film which is formed in proximity to one opening of said hole and to which the distal end of said electrically conducting wire is connected, and a hole conducting film which is formed on the inner wall surface of said hole in a state of electrical continuity with said connecting conducting film and which makes contact with the contact of the receptacle at the other opening of said hole.

In this plug connector, the state of engagement between the plug connector and the receptacle, the conducting wire has electrical continuity with the receptacle via the connecting conducting film and the hole conducting film.

Because the electrically conducting wire has a structure in which it is connected to a connecting conducting film, no other connecting parts are necessary.

The plug connector in another embodiment is a plug connector wherein said correcting conducting films are formed in proximity to both sides of said one opening of said hole, and the distal end of said electrically conducting wire is connected to each of said connecting conducting films by extending across said one opening.

In this plug connector, the electrically conducting wire is connected to the connecting conducting film on both sides of one opening of the hole, and the contact area between the electrically conducting wire and the connecting conducting film is large, and a connection having high reliability can be established.

The plug connector in another embodiment is a plug connector wherein a recess For accommodating solder is positioned in proximity to said one opening of said hole, said connecting conducting films are formed on the inner wall of said recess and around the periphery of said recess, and said electrically conducting wire is soldered to said connecting conducting films by the solder accommodated in said recess.

In this plug connector, because the solder is accommodated in recesses, when the electrically conducting wire is soldered, the solder can be stably placed on the substrate.

The above-mentioned plug connector is a plug connector, wherein a plurality of electrically conducting wires form one cable by being connected in parallel while maintaining a mutually insulated state, a plurality of said conducting parts are provided each independently in said plug connector, and the distal end of each of the electrically conducting wires of said cable is respectively connected to one of said conducting parts.

In addition, the plug connector in another embodiment is a plug connector wherein guide members are attached to said cable, guide grooves which engage said guide members are provided in said substrate, and when said guide members are engaged in said guide grooves, with respect to one of said electrically conducting wires and one of said holes, the distal end of said electrically conducting wire is disposed so as to extend across said one opening of said hole and to pass over the upper surface of said recesses.

In this plug connector, even in a cable having a plurality of electrically conducting wires, each of the electrically conducting wires and the conducting parts can be positioned simply by engaging the guide member in the guide groove.

DETAILED DESCRIPTION OF THE INVENTION

Figure 1:
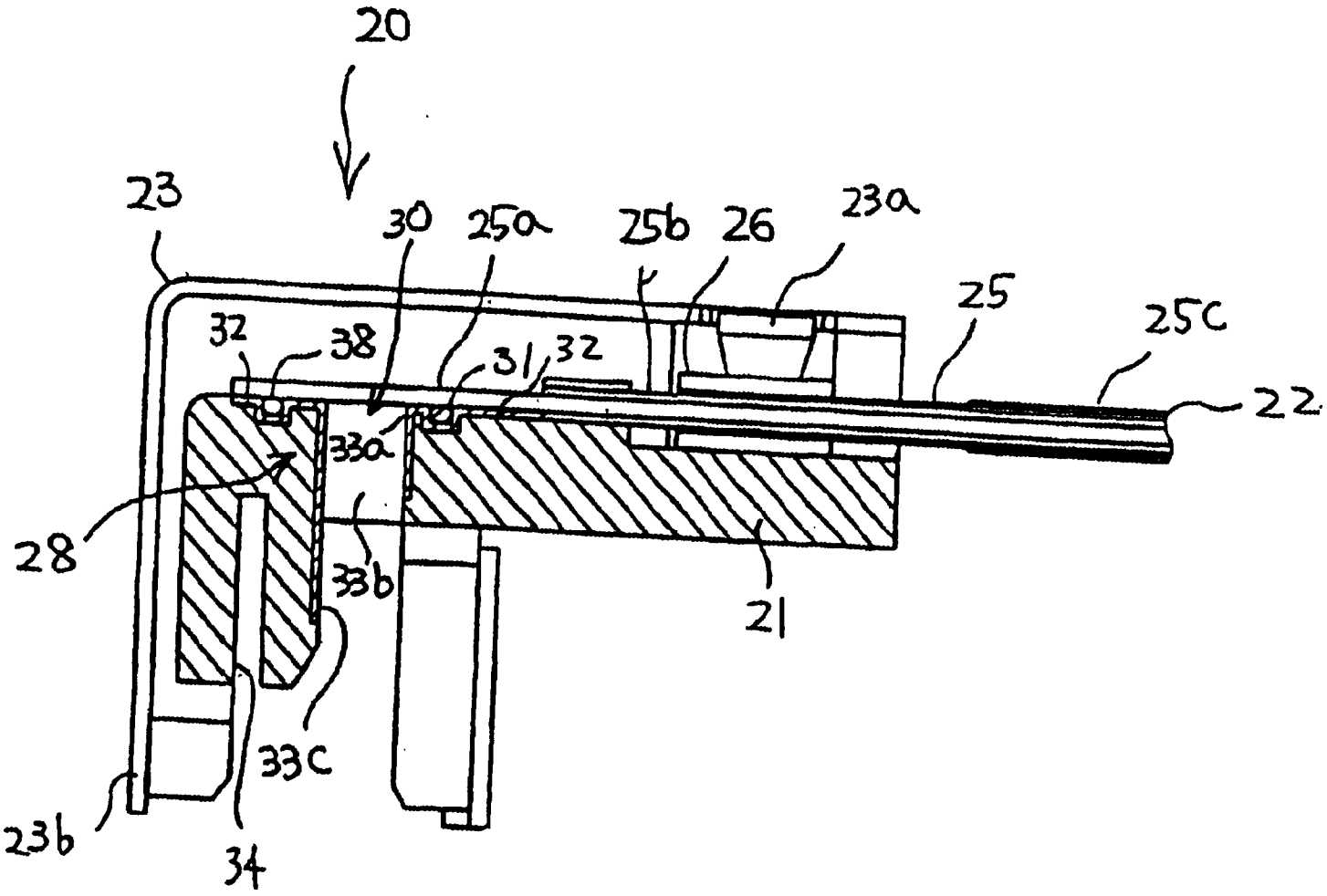
FIG. 1 is a perspective drawing of the plug connector shown as an embodiment of the present invention.

Next, an embodiment of the present invention will be explained referring to the figures.

In the figures the following reference numbers are used:

20 plug connector

21 plug housing (substrate)

25*a* inner conductor (conducting wire)

28 conducting part

31 recess

32 connecting conducting film

33*a*, 33*b*, 33*c*, 33*d* hole conducting films

40 receptacle

42 contact

FIG. 1 shows a plug connector according to the present example. The plug connector 20 comprises a plastic plug housing (substrate) 21, and a metal shell 23 that covers the plug housing 21, and a flat ribbon cable 22 is connected into the plug housing 21.

Figure 2:
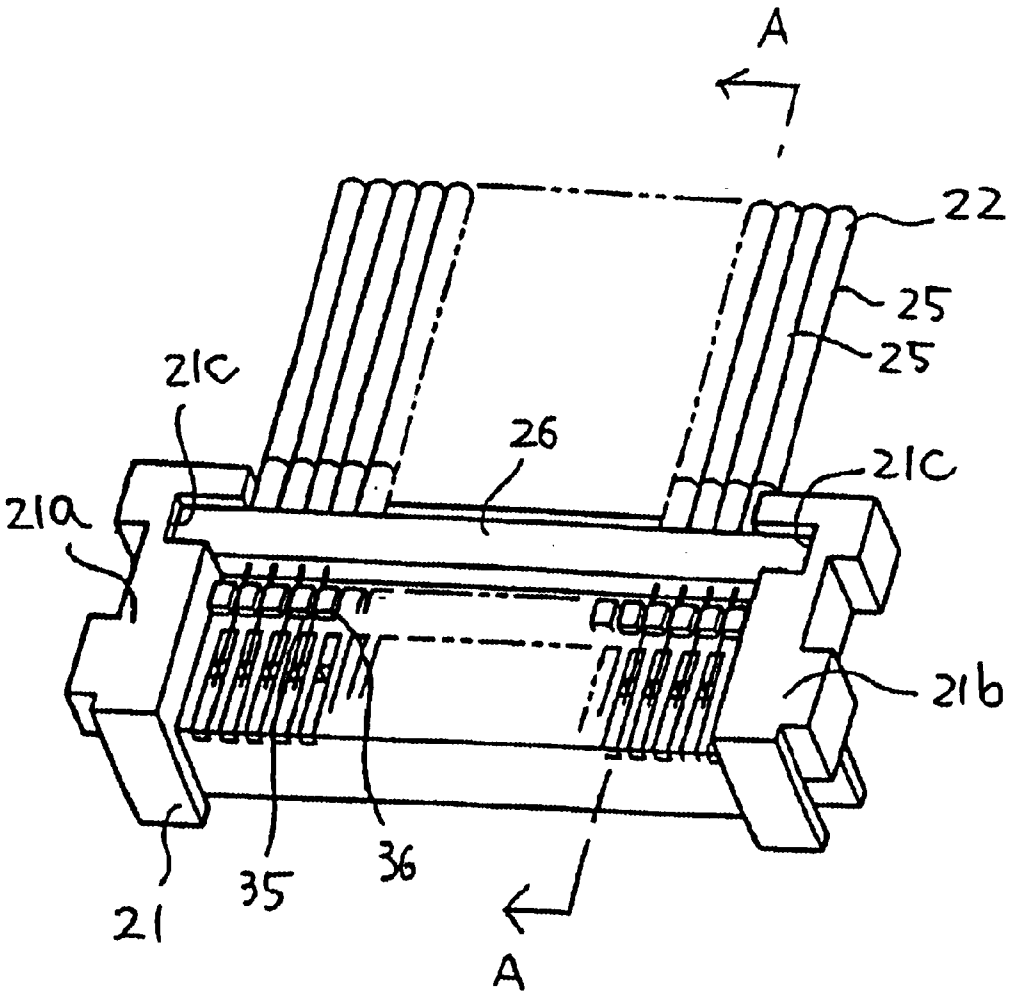
FIG. 2 is a perspective drawing of this plug connector, and the metal shell has been omitted from the drawing.

FIG. 2 is a perspective drawing of the plug connector 20, omitting the metal shell 23 from the figure, and the view along the arrow of the line A—A in the figure corresponds to the view in FIG. 1.

In FIG. 1 and FIG. 2, the flat ribbon cable 22 has a plurality of coaxial cables 25 connected in parallel in the direction of the paper surface, and has a ribbon shape. The coaxial cable 25 provides an inner conductor (conducting wire) 25*a* in the center, an outer conductor 25*b* on the outside thereof, and another covering material 25*c* on the outside thereof.

At the distal end of each of the coaxial cables 25, the inner conductor 25*a* is exposed, and is electrically and mechanically fastened to the conducting part 28 of a conductor provided on the surface of the plug housing 21 corresponding to each inner conductor 25*a*.

Figure 3:
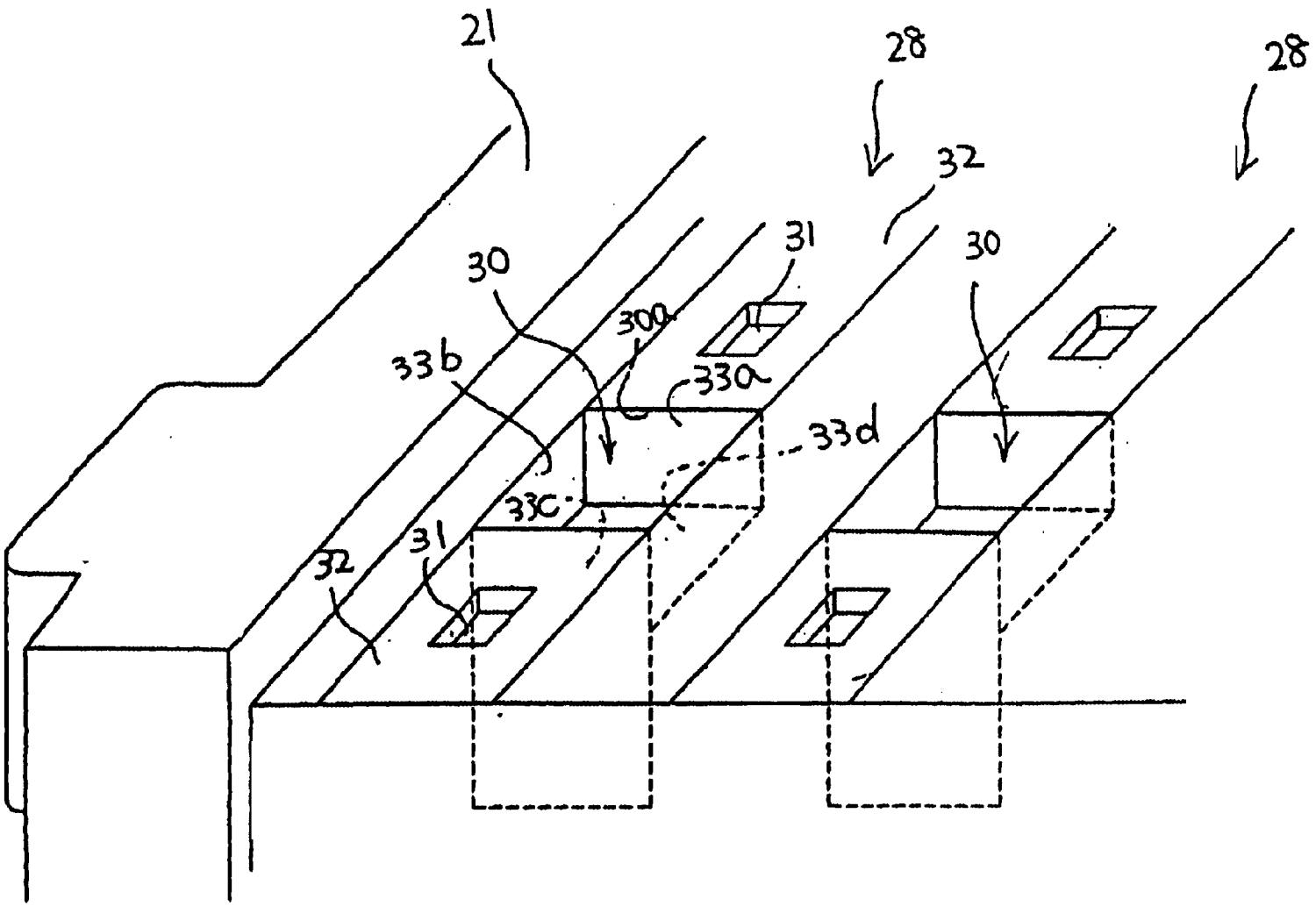
FIG. 3 is an enlarged drawing of the conducting part of this plug connector.

An enlarged drawing of the conducting part 28 is shown in FIG. 3.

Holes 30 are provided passing through the plug housing 21 in the direction of the front to the back thereof. In proximity to the opening part 30*a* on the side surface of the holes 30, recesses 31 and 31 are formed in the plug housing 21, and in these recesses 31 and 31, a solder ball, described below, is accommodated. In the plug housing 21, connecting conducting films 32 and 32 are formed on the inner walls of the recesses 31 and 31 and around the recesses 31 and 31. On the inner walls of the hole 30, hole conducting films 33*a*, 33*b*, 33*c*, and 33*d* are formed, continuous with the connecting conductor films 32 and 32. The connecting conductor films 32 and 32 and the hole conducting films 33*a*, 33*b*, 33*c*, and 33*d* are in a mutually conductive state, and form a conducting part 28.

The connecting conducting films 32 and 32 and the hole conducting films 33*a*, 33*b*, 33*c*, and 33*d* are integrally plated on the surface of the plug housing 21 by well-known MID (Molded Interconnect Device) processing technology.

In addition, a guide hole 34 is formed in the under surface of the plug housing 21 in proximity to the hole 30.

The outer conductor 25*b* of each coaxial cable 25 is electrically connected to the rectangular ground bar 26, which is an electrical conductor.

The side walls 21*a* and 21*b* are provided on the left and right of the upper surface of the plug housing 21, and on the side walls 21*a* and 21*b*, guide grooves 21*c* and 21*c* engaging the ground bar 26 from above are formed. In addition, in the plug housing 21, a guide part 36 is formed that provides a guide groove 35 into which the inner conductor 25*a* of each coaxial cable 25 is inserted in a state wherein the ground bar 26 is engaged with the guide grooves 21*c* and 21*c*.

By providing these guide grooves 21*c* and 21*c* and the guide groove 35, when the flat ribbon cable 22 is engaged in the plug housing 21, the inner conductor 25*a* of each coaxial cable 25 is positioned on the conducting part 28 corresponding to each. In addition, the inner conductor 25*a* extends over the hole 30, and is disposed passing over the upper surface of both recesses 31.

The guide grooves 21*c* and 21*c* prevent the movement in the forward and rearward directions of the ground bar 26. Thereby, when the flat ribbon cable 22 is pulled, the pulling force is prevented from being transmitted to the connection part between the inner conductor 25*a* and the connecting conducting films 32 and 32, and the connection part can be maintained.

The metal shell 23 is a conducting body, is anchored to the plug housing 21, and covers the plug housing 21 and the distal end of the flat ribbon cable 22. A pressing part 23*a* that curves on the inside is provided in a part of the upper surface of the metal shell 23, and the pressing part 23*a* contacts the ground bar 26, and at the same time, prevents the upward and downward movement of the ground bar 26. In addition, the lower part 23*b* thereof acts as a guide when the receptacle 40 described below is inserted.

Next, the assembly method of the plug is explained.

Figure 4:
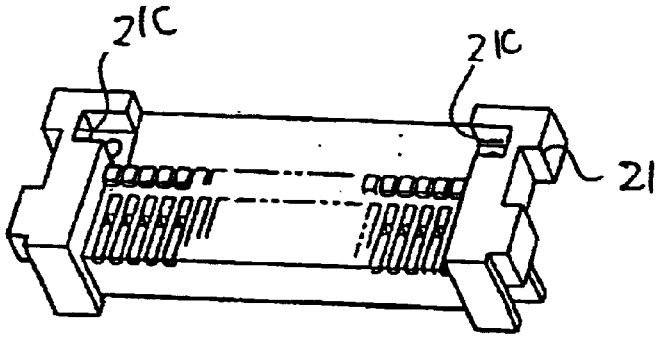
FIG. 4 is a drawing showing the process of connecting the cable to this plug connector.
Figure 4B:
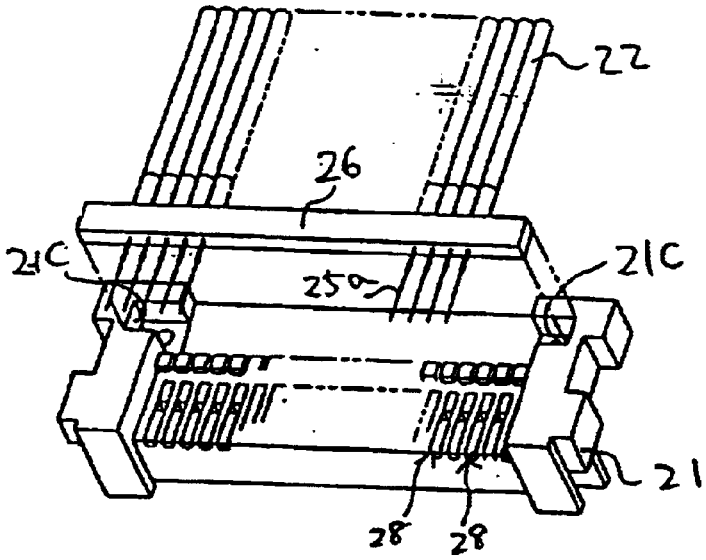
Figure 4:
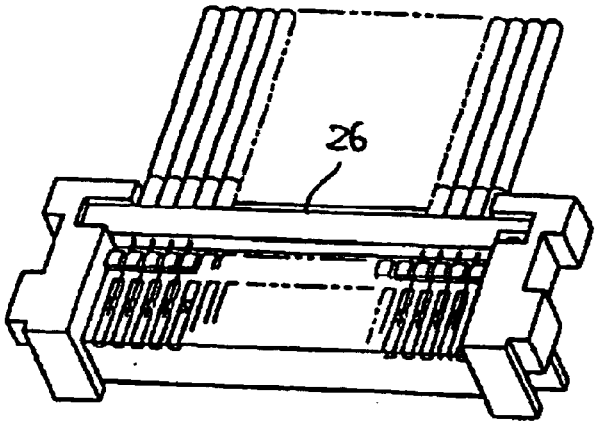

As shown in FIGS. 4(*a*) and (*b*), the ground bar 26 of the flat ribbon cable 22 engages from above the guide grooves 21*c* and 21*c* of the plug housing 21. As shown in FIG. 1, the solder ball 38 is accommodated in advance in the recess 31, and when an electron beam irradiates the solder ball 38 to heat it in the state shown in FIG. 4(*c*), the solder ball 38 melts, and at the same time, the inner conductor 25*a* and the connecting conducting film 32 and 32 are soldered. In this manner, by means of the presence of the recess 31, the solder ball 38 can be stably set at a predetermined position.

Figure 5:
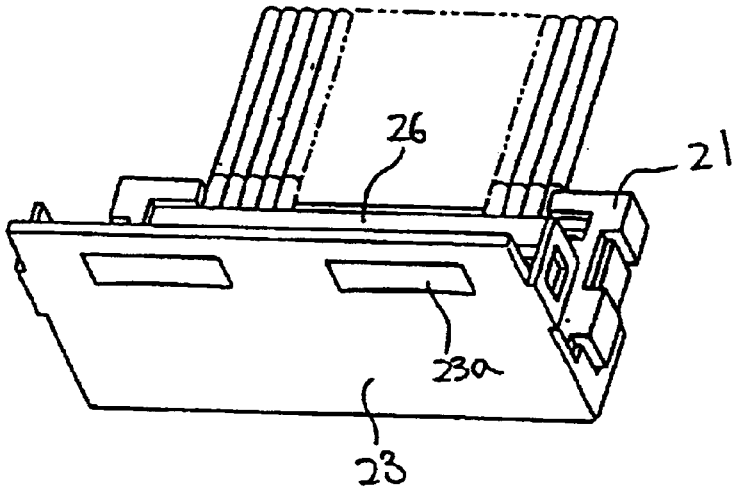
FIG. 5 is a drawing showing the process of connecting the cable to this plug connector.
Figure 5:
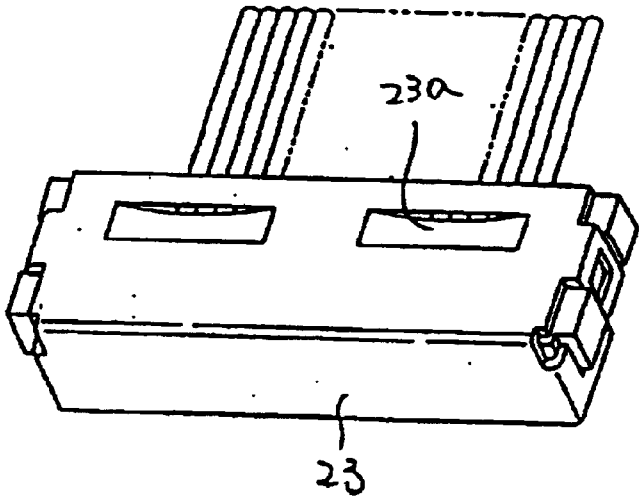

Next, as shown in FIG. 5(*a*), the lower half of the metal shell 23 is mounted on the plug housing 21, and as shown in (*b*), the upper half is bent down onto the plug housing 21 side and anchored to the plug housing 21. At this time, the pressing part 23*a* that is formed in advance in the metal shell 23 is anchored in a state pressing the ground bar 26.

Figure 6:
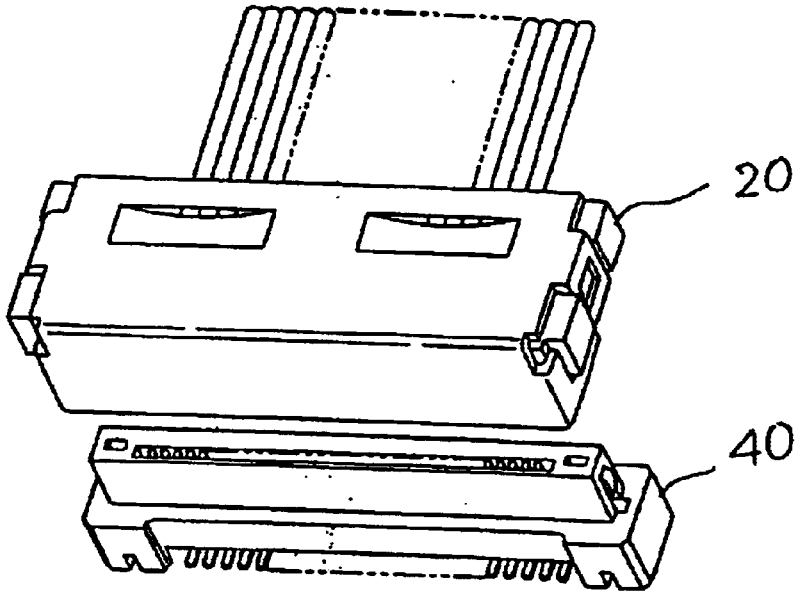
FIG. 6 is a drawing of the engagement between this plug connector and the receptacle.
Figure 6:
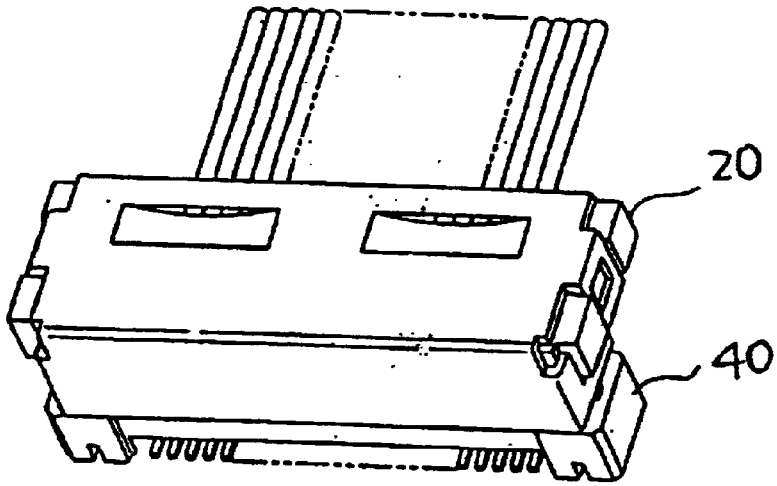
Figure 7:
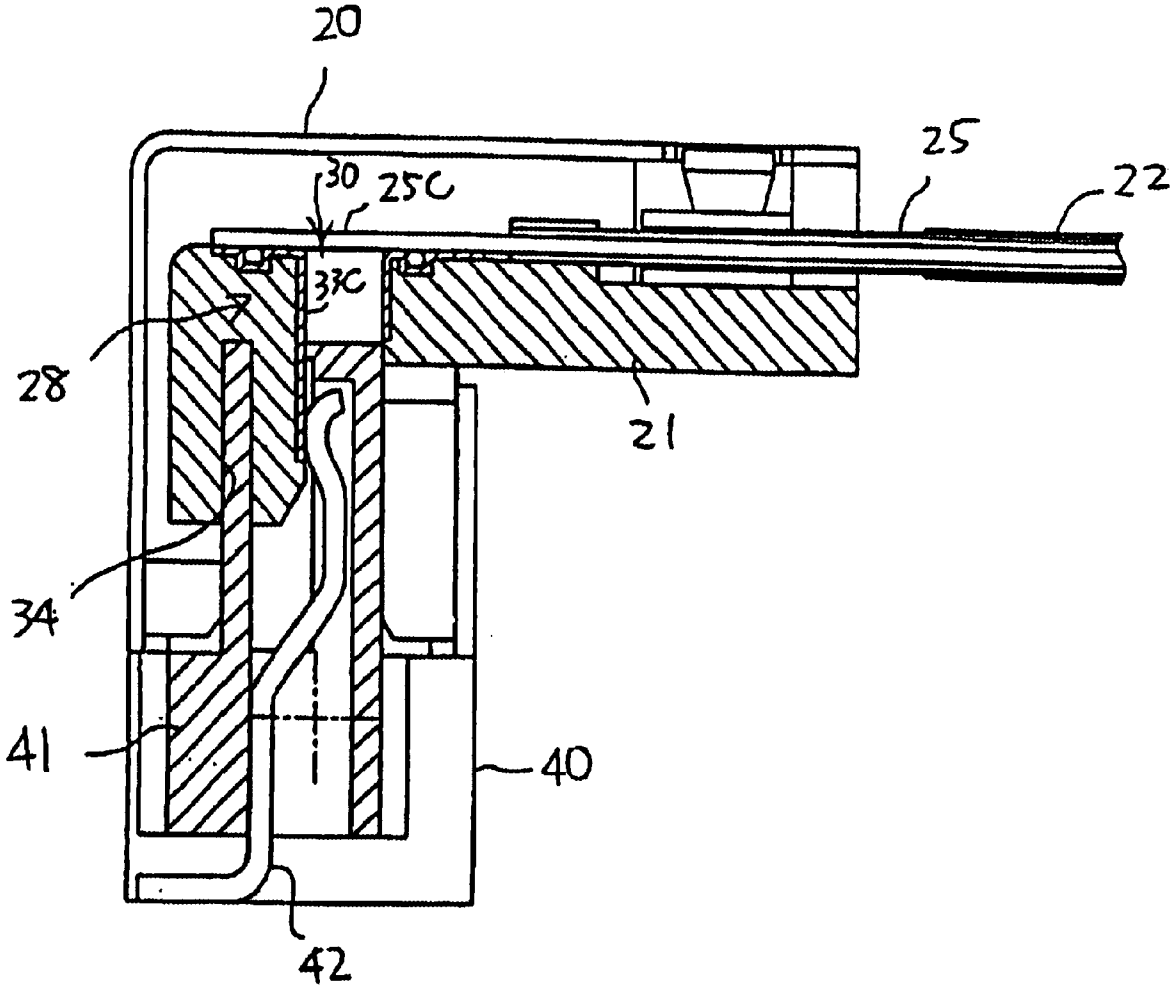
FIG. 7 is a cross-sectional drawing of the state of this plug connector engaged with the receptacle.
Figure 8:
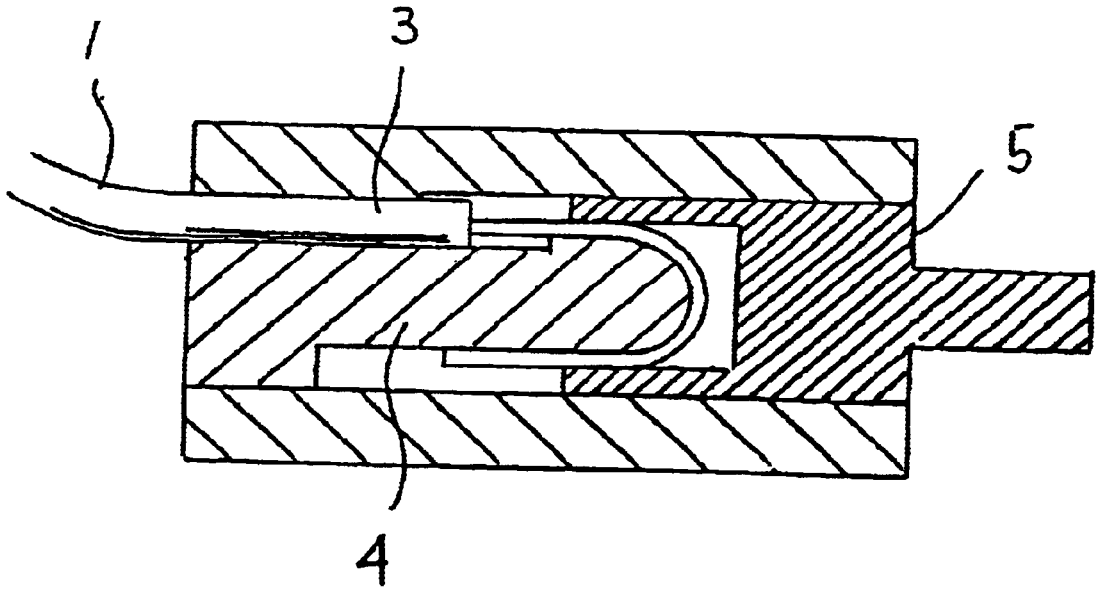
FIG. 8 is a cross-section showing a conventional plug connector.

The receptacle 40 that is mounted in advance on a substrate (not illustrated) is inserted into and engaged with the plug connector 20 formed in this manner, as shown in FIGS. 6(*a*) and (*b*). A cross-sectional drawing of the engaged state is shown in FIG. 7. The receptacle 40 provides a receptacle housing 41, and in the receptacle housing 41, contacts 42 corresponding respectively to the coaxial cables 25 of the flat ribbon cable 22 are provided. The upper end of the receptacle housing 41 and the contact 42 are formed so as to protrude upwards, and to be inserted from below into the holes 30 of the conducting part 28 provided in the plug housing 21. At this time, the receptacle 40 is also guided to engagement by the lower part 23*b* of the metal shell 23 and the guide holes 34. In addition, the distal end of the contact 42 makes contact with the conductive film 33*c* inside the holes, and is electrically connected with the inner conductor 25*a* of the corresponding coaxial cable 25. In addition, the metal shell 23 and the cover of the receptacle housing 21 come into contact, and the ground bar 23 is in electrical continuity with the receptacle 40.

The combination of the plug connector 20 and the receptacle 40 is used when connecting cables that freely rotatably connect the display and the body of a notebook computer.

As explained above, in the plug connector of the present embodiment, the flat ribbon cable 22 can be set, and simply by soldering, without having to assemble any other parts, the coaxial cable 25 is fastened. It is positioned simply by engaging the ground bar 26 in the guide groove 21*c*. Therefore, in the plug connector 20, the number of parts and the number of assembly processes can be reduced.

Moreover, a contact 42 need not necessarily be inserted into a hole 30. For example, a part of the hole conducting film 33*a* to 33*d* inside the hole can be extended outside the hole 30 from the lower opening of the hole 30, and the contact brought into contact with this member.

As explained above, in the plug connector according to the present invention, the conducting wires can be fastened without assembling any other parts, and thus, the number of parts and the number of assembly steps can be reduced.

What is claimed is:

1. A plug connector which connects distal ends of electrically conducting wires and engages receptacles, and in which said electrically conducting wires and contacts provided in said receptacles conduct electricity due to the engagement, said plug connector characterized by comprising:

a substrate for an insulating body, and a film-shaped conducting part formed on a surface of said substrate, said surface defining a hole with a conducting film portion of the film-shaped conducting part therein, said hole being located in the plug connector so that said conducting film portion of the film-shaped conducting part makes contact with the contact of said receptacle when said plug connector and said receptacle are engaged, wherein the distal end of said electrically conducting wire is connected to said conducting part.

2. A plug connector which connects distal ends of electrically conducting wires and engages receptacles, and in which said electrically conducting wires and contacts provided in said receptacles conduct electricity due to the engagement, said plug connector characterized by comprising:

a substrate for an insulating body, and a film-shaped conducting part formed on a surface of said substrate, said film-shaped conducting part making contact with the contact of said receptacle when said plug connector and said receptacle are engaged, wherein the distal end of said electrically conducting wire is connected to said conducting part, and wherein holes are provided in said substrate and, with respect to each hole, said film-shaped conducting part comprises:

a connecting conducting film which is formed in proximity to one opening of said hole and to which the distal end of said electrically conducting wire is connected, and a hole conducting film which is formed on an inner wall surface of said hole in a state of electrical continuity with said connecting conducting film and which makes contact with the contact of the receptacle at the other opening of said hole.

3. A plug connector according to claim 2, wherein said connecting conducting films are formed in proximity to both sides of said one opening of said hole, and the distal end of said electrically conducting wire is connected to each of said connecting conducting films by extending across said one opening.

4. A plug connector according to claim 2, wherein a recess for accommodating solder is positioned in proximity to said one opening of said hole, said connecting conducting films are formed on the inner walls of said recess and around the periphery of said recess, and said electrically conducting wire is soldered to said connecting conducting films by the solder accommodated in said recess.

5. A plug connector according to claim 2, wherein a plurality of electrically conducting wires form one cable by being connected in parallel while maintaining a mutually insulated state, a plurality of said conducting parts are provided each independently in said plug connector, and the distal end of each of the electrically conducting wires of said cable is respectively connected to one of said conducting parts.

6. A plug connector according to claim 5, wherein guide members are attached to said cable, guide grooves which engage said guide members are provided in said substrate, and when said guide members are engaged in said guide grooves, with respect to one of said electrically conducting wires and one of said holes, the distal end of said electrically conducting wire is disposed so as to extend across said one opening of said hole and to pass over the upper surface of said recesses.

* * * * *